United States Patent [19]

Crepinsek

[11] 3,992,908

[45] *Nov. 23, 1976

[54] DOOR LOCK HOUSING ASSEMBLY AND RELEASABLE CATCH

[75] Inventor: Alois Crepinsek, El Paso, Tex.

[73] Assignee: International Top Security Corporation, El Paso, Tex.

[ * ] Notice: The portion of the term of this patent subsequent to Jan. 27, 1993, has been disclaimed.

[22] Filed: May 8, 1975

[21] Appl. No.: 575,504

Related U.S. Application Data

[63] Continuation-in-part of Ser. No. 531,926, Dec. 12, 1974.

[52] U.S. Cl. ..... 70/370; 70/451; 70/DIG. 60

[51] Int. Cl.² ..... E05B 9/08

[58] Field of Search ..... 70/370, 372, 373, 374, 70/448, 449, 451, DIG. 60

[56] References Cited

UNITED STATES PATENTS

| | | | |
|---|---|---|---|
| 391,826 | 10/1888 | Taylor | 70/370 |
| 743,695 | 11/1903 | Dimock | 70/370 X |
| 777,130 | 12/1904 | Noack | 70/370 |
| 1,684,230 | 9/1928 | Lach | 70/370 |
| 2,869,353 | 1/1959 | Imhoff | 70/370 |

FOREIGN PATENTS OR APPLICATIONS

| | | | |
|---|---|---|---|
| 97,092 | 1/1924 | Austria | 70/370 |
| 825,218 | 12/1951 | Germany | 70/370 |

*Primary Examiner*—Robert L. Wolfe
*Attorney, Agent, or Firm*—D. Paul Weaver

[57] ABSTRACT

A lock cylinder housing assembly is received in a through bore of a door and coupled therein without the use of external or internal machine screws. A co-acting dead bolt assembly in a bore formed in the door at right angles to the through bore bridges the through bore and extends through a transverse passage of the housing assembly to prevent rotation of the assembly or disassembling thereof from the exterior or interior of the door. A catch release mechanism on the dead bolt assembly is accessible only when the door is open to allow releasing of the catch means which allows removal and disassembly of the housing assembly at the inner side of the door.

7 Claims, 5 Drawing Figures

DOOR LOCK HOUSING ASSEMBLY AND RELEASABLE CATCH

CROSS-REFERENCE TO RELATED APPLICATIONS

This application is a continuation-in-part of prior copending application Ser. No. 531,926, filed Dec. 12, 1974, for LOCK CYLINDER HAVING A RELEASABLE CATCH; and also contains some subject matter in common with application Ser. No. 531,927, filed Dec. 12, 1974, for DOOR BOLT LOCK.

BACKGROUND OF THE INVENTION

Customarily, door lock cylinder housing assemblies are secured within a through bore of the door by one or more machine screws passing from the inside of the assembly outwardly and also from the outside inwardly. From the standpoint of security, this arrangement leaves a lot to be desired because the exterior screws can be removed from the assembly and the remaining interior screw or screws are rather easily broken by continued prying or twisting of the exterior exposed part of the assembly.

Because of this defect in the prior art, the invention was created to provide a door lock in which the lock cylinder housing assembly is coupled or secured within the through bore of the door without machine screws or other separable fasteners, accessible from either the outside or the inside of the door. In a preferred embodiment, the housing parts are coupled by screw-threads within the confines of the through bore.

An intersecting dead bolt assembly in an edge opening of the door extends entirely across the door through bore at right angles to the housing assembly and also extends through a transverse passage in one of the housing sections so that the same is locked against rotation. A catch device in the housing assembly cooperates with a catch release mechanism on the bolt assembly to normally secure the interior lock cylinder housing section against removal. Only at such times when the door is open and its edge having the dead bolt assembly is exposed, can the catch device be released by the movement of a plunger means, preferably contained in the interior of the dead bolt.

Other features and advantages of the invention will become apparent during the course of the following description.

BRIEF DESCRIPTION OF DRAWING FIGURES

DETAILED DESCRIPTION

Figure 1:
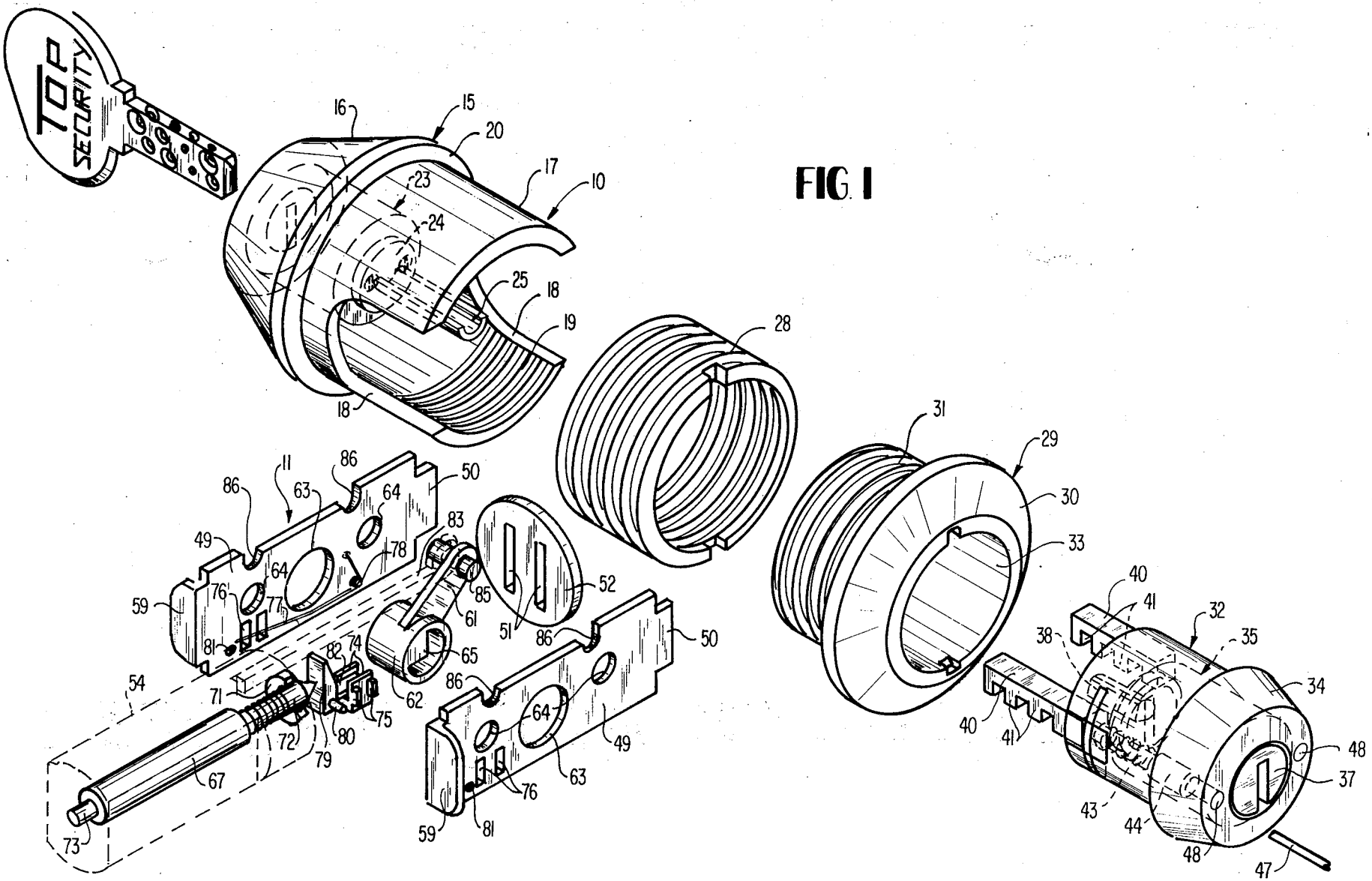
FIG. 1 is an exploded perspective view of a door lock mechanism embodying the invention and showing the two major assemblies thereof in right angular relationship.
Figure 3:
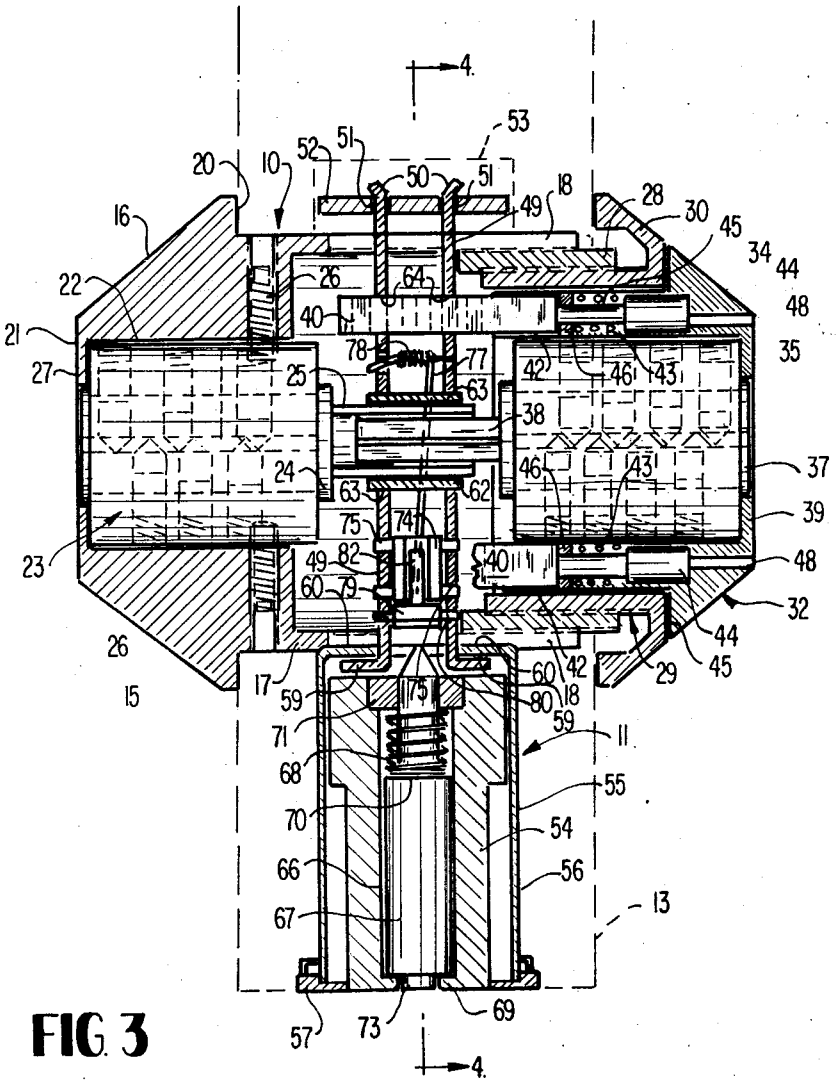
FIG. 3 is a completely assembled horizontal cross section through the door lock mechanism with the dead bolt in a retracted position and with the releasable catch of the cylinder housing assembly still engaged.

Referring to the drawings in detail, wherein like numerals designate like parts, a door locking mechanism embodying the present invention comprises a lock cylinder housing assembly 10, shown separated or exploded in FIG. 1 and fully assembled in FIG. 3. A dead bolt assembly 11 is similarly shown in its entirety in FIGS. 1 and 3 and these two assemblies form the main components of the entire lock mechanism.

The cylinder housing assembly 10 is installed in a through bore 12 of a door 13, and the dead bolt assembly 11 in installed in a right angular intersecting opening 14 of the door, as shown in the drawings. These two major assemblies coact in the invention in a unique manner, now to be described in detail.

The assembly 10 comprises an exterior housing section 15 having an outer smooth conically tapered head 16 and an interior sleeve extension 17 which is slotted at diametrically opposite points entirely through its rear end as at 18. The sleeve extension 17 is internally screw-threaded at 19 and the conical head 16 has a flat annular shoulder 20 at its inner end which abuts the outer face of the door 13 radially outwardly of the door through bore 12. The outer end of housing section 15 terminates in a flat face 21, and the exterior housing section has a cylindrical chamber 22 receiving an exterior lock cylinder unit 23 having a key-operated rotary plug 24 including a rearwardly projecting spline 25. The cylinder unit 23 is held within the housing section 15 by radial set screw means 26, the outer end of the cylinder unit abutting an annular flange 27 of the head 16 immediately surrounding the key-operated plug 24.

The assembly 10 additionally comprises an internally and externally threaded coupling sleeve 28 which enters the threads 19 of housing section 15 and serves to couple the latter adjustably with an interior housing section 29 having a conically tapered head 30 which abuts the interior face of the door 13 in assembly radially outwardly of and surrounding the through bore 12. The housing section 29 is externally threaded at 31 to enter the internal threads of coupling sleeve 28 as depicted in FIG. 3. The coupling sleeve 28 thus forms an extending or adjusting element whereby the housing assembly 10 may be mounted on doors of varying thickness. On doors which are sufficiently thin, the sleeve 28 may not be needed, in which cases the two housing sections 15 and 29 may be directly engaged through their screwthreads in the assembly.

Figure 2:
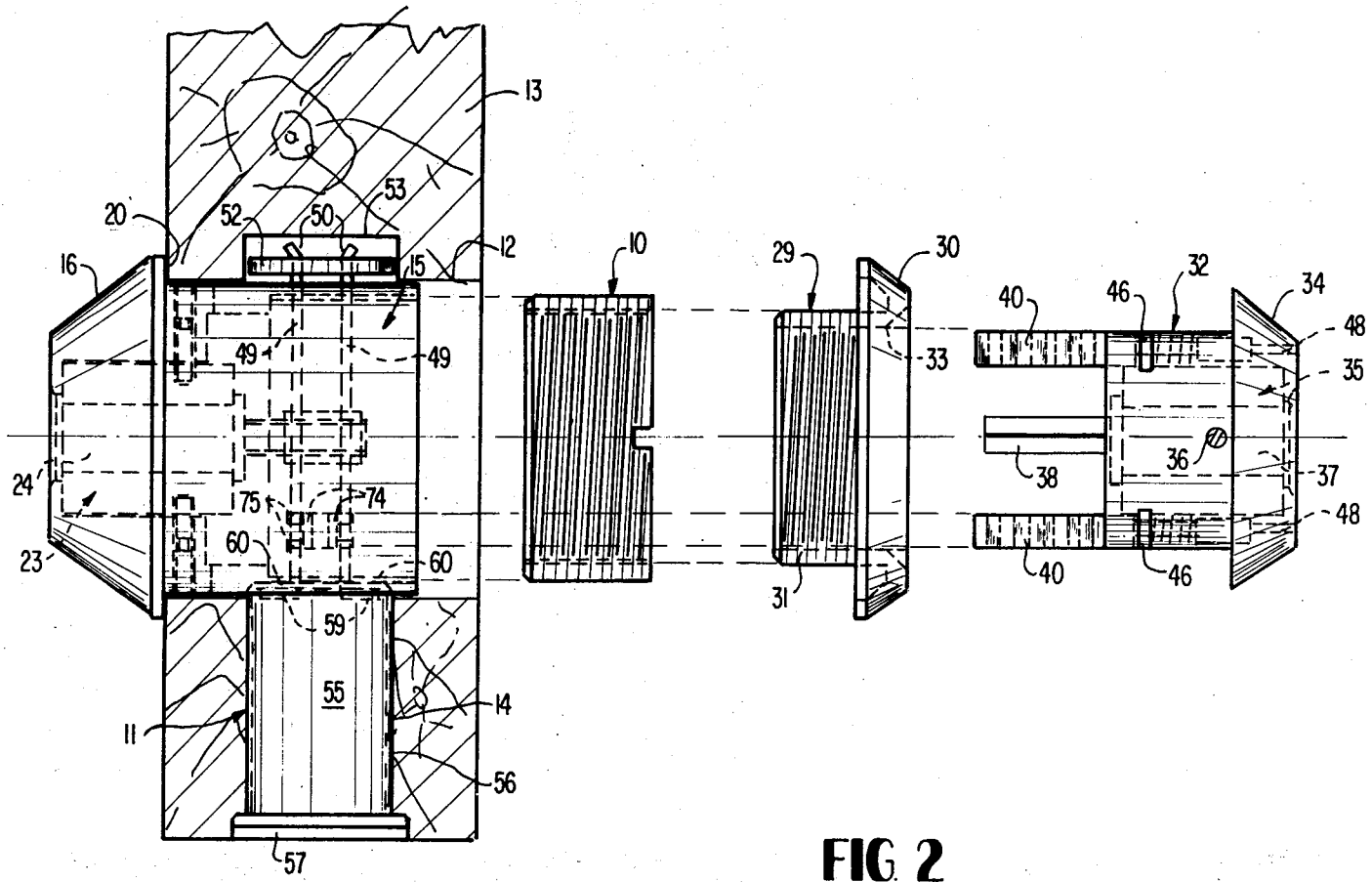
FIG. 2 is a partly assembled, partly exploded plan view of the invention in relation to a door receiving the invention, the door being shown in horizontal cross section.
Figure 4:
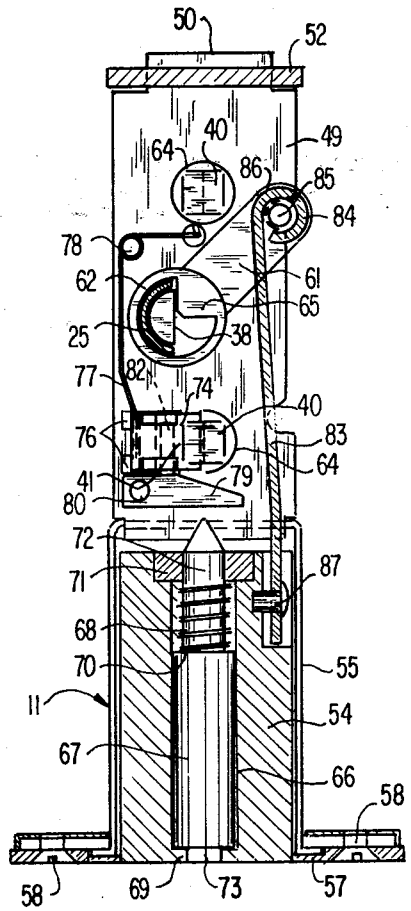
FIG. 4 is a vertical section taken on line 4—4 of FIG. 3.

The housing assembly 10 additionally comprises an interior cylindrical insert 32 adapted to be received in a bore 33 of housing section 29. The insert 32 has a conical head 34 at its inner end which forms a smooth continuation of the tapered head 30 when the parts of the assembly 10 are placed together, as shown in FIG. 3. An interior lock cylinder unit 35 is contained within a chamber of the insert 32 and held therein by set screw means 36, FIG. 2. The cylinder unit 35 has a rotary key-operated plug 37 including a spline 38 which interfits telescopically in assembly with the spline 25, FIGS. 3 and 4. An annular flange 39 on the housing section 29 surrounds the plug 37 and overlies the outer end of cylinder unit 35.

The insert 32 also carries a pair of laterally spaced parallel longitudinally extending toothed catch elements or dogs 40, one for right hand applications, and one for left hand. The evenly spaced teeth 41 of these dogs project downwardly in relation to the bottom edge of the door 13 on which the mechanism is installed. More particularly, the two dogs 40 have their rear end portions received in parallel openings 42 in the leading end of insert 32 and the dogs project forwardly of the insert and forwardly of the elements 31 and 28 in assembly, as shown in FIG. 3. The dogs 40 project well into the sleeve extension 17 of exterior housing section 15. The two dogs 40 are biased rearwardly or toward the interior of the door by srings 43 which bear against heads 44 on reduced stems 45 extending rearwardly of the catch elements or dogs 40 and fixed thereto. The forward ends of the springs 43 bear on insert plates 46 or stops which positively limit the rearward movement of the dogs 40 under influence of the springs 43. The dogs can be urged forwardly at certain times against the yielding springs under influence of a slender implement or pin 47, FIG. 1, insertable into one of a pair of small openings 48 in the interior end of the insert 32. The implement 47 will engage the head 44 and shift the dog 40 slightly forwardly, as will be further described during the release operation.

The dead bolt assembly 11 comprises a pair of side plates 49 which extend across the door through bore 12 as a bridge in spaced parallel relation. Rearward extensions 50 on the side plates 49 are received through spaced slots 51 in a rigid washer 52 or plate, which is received within a recess 53 formed in the door, leading from one side of the through bore 12. As shown clearly in FIGS. 2 and 3, the extensions 50 are bent outwardly after being received through the slots 51 to effectively lock the parts in rigid assembled relationship. The two side plates 49 extend through the slots 18 in sleeve extension 17 of the exterior housing section 15. Because of this arrangement, the exterior housing section 15 is locked by the side plate 49 against rotation, thus assuring that the lock cannot be disassembled from the outer side of the door.

A dead bolt 54 is contained slidably within a bolt housing 55 mounted within a door edge opening 56 extending at right angles to and intersecting the through bore 12. The mentioned recess 53 is a mere continuation of the edge opening 56. The bolt housing 55 is held within the opening 56 by a suitable keeper plate 57 arranged flush with the free edge of the door and held in a shallow recess by screws 58. Forward lateral extensions 59 on side plates 49 are locked forwardly of tabs 60 on the inner end of bolt housing 55. Thus the bridging side plates 49 are supported at the opposite sides of the door through bore 12 while extending across this bore diametrically, as described. The washer or plate 52 preferably fits snugly in the recess 53 to effect stable supporting of the two side plates 49.

A dead bolt drive arm 61 extends radially from a cylindrical hub 62, received rotatably within aligned openings 63 of side plates 49. The right and left hand catch elements or dogs 40 pass through clearance openings 64 provided in the side plates 49 on opposite sides of the openings 63. The two splines 25 and 38 of the exterior and interior lock cylinder plugs 24 and 37 project through the bore of hub 62 in telescoped relationship, FIGS. 3 and 4. The hub 62 has a single internal tapered tooth 65 in the path of movement of both rotary splines 25 and 38 so that when either of the latter is turned by a key, the bolt drive arm 61 will be turned in the proper direction to retract the bolt 54, which is shown retracted in FIGS. 3 and 4. Thus the door may be unlocked by means of a key at the inside or outside but may not be otherwise unlocked or opened. The exterior and interior key lock cylinders defeat unauthorized entry by breaking an adjacent glass pane and reaching through to open the door from the inside, as where a customary inside door knob is provided. The inside lock cylinder housing section 29 and insert 34 are also held against rotation when the parts are assembled by the interlocking of the dogs 40 and side plates 49 through the openings 64 thereof. As will be further described, only when the door is opened by use of a key and the edge having the dead bolt 54 exposed can the lock cylinder housing assembly 10 be separated or released from the inside of the door only.

Mounted within a central bore 66 of dead bolt 54 is a catch release plunger 67, urged forwardly in the bore 66 by a spring 68. A forward flange 69 of the dead bolt 54 prevents the escape of the plunger 67 from the dead bolt bore. The spring 68 is held captive betwen a shoulder 70 of the plunger 67 and an apertured plug 71 secured within a recess in the inner end of the dead bolt 54. A reduced tapered pin extension 72 of the catch release plunger 67 projects through and inwardly of the plug 71, as shown in the drawings. The plunger 67 is adapted to be shifted axially inwardly from its normal position shown in FIGS. 3 and 4 by a suitable implement brought into engagement with a leading pin extension 73 on the plunger accessible only when the dead bolt 54 is retracted responsive to key operation on one of the plugs 24 or 37, and the door 13 is open. The inward catch release position of the plunger 67 is depicted in FIG. 5.

A generally channel-shaped latch member having two spaced teeth 74 is positioned between the side plates 49 directly below one catch element 40, depending upon whether a right hand or a left hand installation is involved. The latch member has opposite side pairs of lugs 75 which engage slidably in elongated lug receiver slots 76 of the side plates 49 whereby the latch member may have limited movement of its teeth 74 toward and from the adjacent catch element 40 having the teeth 41. The teeth 74 of the shiftable latch member are normally biased into interlocking engagement with adjacent teeth 41 of catch element 40, FIG. 4, by a spring arm 77 anchored as at 78 to the side plates 49. A latch release lever 79 pivoted at 80 to the side plates 49 through pivot openings 81 thereof is in the path of movement of plunger extension 72. The release lever 79 has an extension 82 extending between the latch teeth 74, FIG. 5, and adapted when shifted by the plunger extension 72 around the pivot 80 to move the latch member teeth 74 against the spring arm 77 and clear of interlocking engagement with catch element teeth 41. Upon removal of the plunger extension 72 forwardly by spring 68, the teeth 74 will return under influence of spring arm 77 into normal interlocking engagement with catch teeth 41. The catch elements 40 are also shiftable by the described implement 47 in relation to the teeth 74 by a distance equal to the spacing of one pair of teeth 41. Thus, to assure proper interengagement of the cooperating teeth 41 and 74 when assembling the lock, the particular active catch element 40 should be shifted against its spring 43 by means of the implement 47 being inserted through the proper opening 48.

Figure 5:
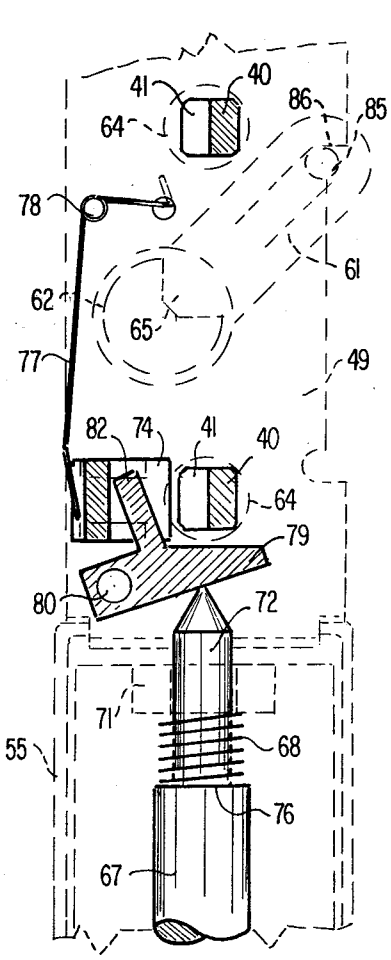
FIG. 5 is an enlarged fragmentary view similar to FIG. 4 showing the catch release mechanism in cross section and being activated by the plunger of the dead bolt.

In disassembling the lock with the door open, the plunger 67 is forced inwardly to the position shown in FIG. 5 to withdraw the teeth 74 from engagement with the catch teeth 41. This releasing of the catch element 40 will allow the insert 32 to be separated from housing section 29, assisted by springs 43, following which interior housing section 29 may have its threads uncoupled from sleeve 28. This will then allow removal of the exterior lock cylinder housing 15 whose slots 18 are straddling the two side plates 49. Thus, only after the withdrawal of the latch teeth 74 from the teeth 41 of catch element 40 by utilizing plunger 67 may the housing assembly 10 be separated starting from the inside of the door, as described.

The key operated dead bolt drive arm 61 is operatively connected to the dead bolt 54 by suitable drive link 83 having a knuckle 84 surrounding a trunnion pin 85 adapted to be pivotally held in a pair of aligned trunnion seats 86 in the top edges of side plates 49. Two pairs of such seats are provided, FIG. 1, for right and left hand door installations. The bolt drive link 83 is coupled with the dead bolt 54 as at 87 in FIG. 4, or in any other suitable way. The link 83 and dead bolt 54 are shown schematically only in broken lines in FIG. 1.

In summation, therefore, the invention provides a door locking mechanism having a high degree of security against unauthorized entry through a door. To open the door, a key must be used either from the inside or the outside. No hand knobs are employed. The conical shape of the heads 16, 30 and 34 prevent prying apart or dislodgement of the assembled parts from the inside or outside. Only when the door is properly unlocked and opened can access to the catch release plunger 67 be had, whereby the assembly 10 can be separated only from the inside of the door, as described.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A door lock mechanism comprising a lock cylinder housing assembly adapted for mounting in a through bore of a door and including exterior and interior housing sections, means coupling said housing sections in assembled relationship within the confines of the through bore, whereby the coupling means is inaccessible from the exterior and interior sides of the door, a lock bolt assembly mountable within an edge opening of the door in intersecting relation with said through bore, said lock bolt assembly extending across the through bore and interfitting with the lock cylinder assembly within the through bore to resist rotation of the lock cylinder assembly, interengaging catch means on said lock cylinder assembly and lock bolt assembly normally preventing separation of the coupling means, and movable catch releasing means on the lock bolt assembly accessible and operable from the edge of a door carrying said assemblies when such door is open to expose said edge, said coupling means being screw-threaded and rotational, and said interengaging catch means comprising a toothed catch element on the interior housing section, and a coacting normally active shiftable toothed latch element on said door bolt assembly adapted to be de-activated by said movable catch releasing means, said movable catch releasing means comprising a manually operable plunger on the lock bolt assembly having an interior end portion engageable with a release member having a connection with said toothed latch element, and said release member comprising a pivoted release lever on the lock bolt assembly having a part engaging said toothed latch element to withdraw the latter from the toothed catch element, and a spring means on the lock bolt assembly engaging the toothed latch element and urging it toward interlocking engagement with said catch element.

2. The mechanism of claim 1, and said lock cylinder housing assembly having a transverse through passage entirely within the confines of the door through bore and receiving therethrough said lock bolt assembly, and support means for the interior end of the lock bolt assembly remote from the end thereof accessible at the edge of the door.

3. The mechanism of claim 2, and said lock bolt assembly comprising a pair of spaced substantially rigid plates extending entirely across the door through bore and said transverse through passage with their innermost ends coupled with said support means remotely from the edge of the door.

4. The mechanism of claim 3, and said interengaging catch means including a spring-urged shiftable latch element on said pair of spaced plates, said plates having opening means receiving and supporting parts of said shiftable latch element for constrained linear movement.

5. The mechanism of claim 1, and a spring engaging said plunger and normally urging the plunger away from engagement with said release member.

6. The mechanism of claim 1, and at least one keyoperated lock cylinder on said lock cylinder housing assembly including a key-operated rotary plug having an axially projecting interior end spline, a rotary lock bolt drive arm on the lock bolt assembly operatively coupled with a reciprocating bolt of said assembly and having a drive tooth in the path of rotational movement of said spline, whereby turning of said spline by a key will impart rotation to the bolt drive arm to retract or extend said bolt.

7. The mechanism of claim 6, and a second key-operated lock cylinder on said lock cylinder housing assembly including a key-operated rotary plug having an axially projecting interior end spline which interfits telescopically with the first-named spline, said drive tooth of said lock bolt drive arm also being in the path of rotational movement of the second-named spline of the second key-operated lock cylinder, one lock cylinder being accessible at the exterior of said door and the second lock cylinder accessible at the interior of the door.

* * * * *